US009388569B2

(12) United States Patent
Metzger et al.

(10) Patent No.: US 9,388,569 B2
(45) Date of Patent: Jul. 12, 2016

(54) BRIDGELIKE SUPPORT STRUCTURE MADE OF FIREPROOF CERAMIC BRICKS

(71) Applicant: REFRACTORY INTELLECTUAL PROPERTY GMBH & CO. KG, Vienna (AT)

(72) Inventors: Michael Metzger, Vienna (AT); Harald Kerschbaum, Müllendorf (AT)

(73) Assignee: REFRACTORY INTELLECTUAL PROPERTY GmbH & Co., Vienna (AT)

( * ) Notice: Subject to any disclaimer, the term of this patent is extended or adjusted under 35 U.S.C. 154(b) by 0 days.

(21) Appl. No.: 14/348,125

(22) PCT Filed: Oct. 24, 2012

(86) PCT No.: PCT/EP2012/071006

§ 371 (c)(1),
(2) Date: Mar. 28, 2014

(87) PCT Pub. No.: WO2013/079265

PCT Pub. Date: Jun. 6, 2013

(65) Prior Publication Data

US 2014/0366478 A1 Dec. 18, 2014

(30) Foreign Application Priority Data

Dec. 2, 2011 (EP) ..... 11191724

(51) Int. Cl.
*E04C 1/41* (2006.01)
*F27D 1/02* (2006.01)
(Continued)

(52) U.S. Cl.
CPC . *E04B 1/941* (2013.01); *E04C 1/24* (2013.01); *E04C 1/41* (2013.01); *F27B 1/005* (2013.01);
(Continued)

(58) Field of Classification Search
CPC ..... E04C 1/24; E04C 1/41; F27D 1/025; F27D 1/028; F27D 1/04; F27D 1/045; F27D 1/024; C21B 7/06; F27B 1/005; F27B 1/14
USPC ..... 52/89, 574, 575, 592.1, 608–611; 110/331–335, 338, 339
See application file for complete search history.

(56) References Cited

U.S. PATENT DOCUMENTS 855,495 A * 6/1907 Baldwin ..... 110/335
884,498 A * 4/1908 King ..... 52/89
(Continued)

FOREIGN PATENT DOCUMENTS

DE 6600483 U 1/1969
DE 3714752 A1 * 11/1988 ..... F27B 9/32
(Continued)

OTHER PUBLICATIONS

International Search Report for PCT/EP2012/071006 mailed Jan. 18, 2013.

*Primary Examiner* — Charles A Fox
*Assistant Examiner* — Charissa Ahmad
(74) *Attorney, Agent, or Firm* — Walker & Jocke

(57) ABSTRACT

The invention relates to a bridge-like supporting structure made of fireproof ceramic stones, wherein two outer, end bearing stones have a largely horizontal step on the inner side of the outer, end bearing stones and a keystone arranged between the two bearing stones has at least one corresponding step on the two outer sides of the keystone. By means of said structure, thermal expansions can be better compensated.

13 Claims, 7 Drawing Sheets

(51) Int. Cl.

| | |
|---|---|
| ***E04B 1/94*** | (2006.01) |
| ***E04B 5/00*** | (2006.01) |
| ***F27D 1/04*** | (2006.01) |
| ***F27B 1/00*** | (2006.01) |
| ***F27B 1/14*** | (2006.01) |

(52) U.S. Cl.

CPC . *F27B 1/14* (2013.01); *F27D 1/024* (2013.01); *F27D 1/025* (2013.01); *F27D 1/028* (2013.01); *F27D 1/04* (2013.01); *F27D 1/045* (2013.01)

(56) References Cited

U.S. PATENT DOCUMENTS

| | | | | | |
|---|---|---|---|---|---|
| 1,242,669 | A | * | 10/1917 | Erkens | 52/575 |
| 1,281,976 | A | * | 10/1918 | Keim | 52/575 |
| 1,420,810 | A | * | 6/1922 | Bean | 52/592.1 |
| 1,440,446 | A | * | 1/1923 | Cotton | 110/332 |
| 1,618,780 | A | * | 2/1927 | Reintjes | 52/575 |
| 1,648,363 | A | * | 11/1927 | Reintjes | 52/592.1 |
| 1,655,566 | A | * | 1/1928 | Reintjes | 432/119 |
| 2,067,414 | A | | 1/1937 | Reintjes | |
| 2,158,943 | A | * | 5/1939 | Mamula | 52/89 |
| 2,319,065 | A | * | 5/1943 | Karmanocky | 52/89 |
| 2,645,115 | A | * | 7/1953 | Abeles | 52/223.9 |
| 2,742,023 | A | * | 4/1956 | Reintjes | 122/6 A |
| 2,753,711 | A | * | 7/1956 | Weber | 52/745.07 |
| 3,220,367 | A | * | 11/1965 | Stein | 110/335 |
| 3,396,504 | A | * | 8/1968 | De Oliveira | 52/575 |
| 3,682,457 | A | * | 8/1972 | Hollingsworth | 266/193 |
| 3,831,914 | A | * | 8/1974 | Zimmermann | 266/192 |
| 3,953,009 | A | * | 4/1976 | Kan | C21C 5/44 266/283 |
| 4,628,657 | A | | 12/1986 | Ermer et al. | |
| 5,069,015 | A | | 12/1991 | Steinwender | |
| 6,017,487 | A | | 1/2000 | Fish | |
| D479,342 | S | * | 9/2003 | Dawson | D25/113 |
| 6,705,243 | B2 | | 3/2004 | Kassau | |
| 2002/0124509 | A1 | * | 9/2002 | Smyer, III | 52/439 |
| 2007/0101913 | A1 | * | 5/2007 | Black | 110/338 |

FOREIGN PATENT DOCUMENTS

| | | | | |
|---|---|---|---|---|
| DE | 3933744 | A1 | | 4/1991 |
| DE | 10121699 | A1 | | 11/2002 |
| EP | 0163866 | A1 | | 12/1985 |
| FR | 466811 | | | 5/1914 |
| FR | 579631 | A | * | 10/1924 |
| JP | 2008224145 | A | * | 9/2008 |
| WO | 2009053515 | A1 | | 4/2009 |

* cited by examiner

BRIDGELIKE SUPPORT STRUCTURE MADE OF FIREPROOF CERAMIC BRICKS

The invention relates to a bridge-like support structure made of fireproof ceramic bricks.

In the construction of industrial furnaces, for example of a lime shaft kiln, arches and domes of different widths are made in order to create a furnace space, whereat the arches or the domes are covered (superstructed) for example with fireproof bricks.

In the DE 101 21 699 C5 a load bearing (support) arch structure for a lime shaft kiln is described. The supporting arch consists of two bearing bricks at its ends, which rest on corresponding supports, and a multitude of bricks that are arranged in-between, each of which features a wedge shape in order to create the arch structure and which rest on each other via corresponding steps on their outer surfaces.

Another embodiment for such a support construction is shown in the DE 39 33 744 C2.

Figure 1:
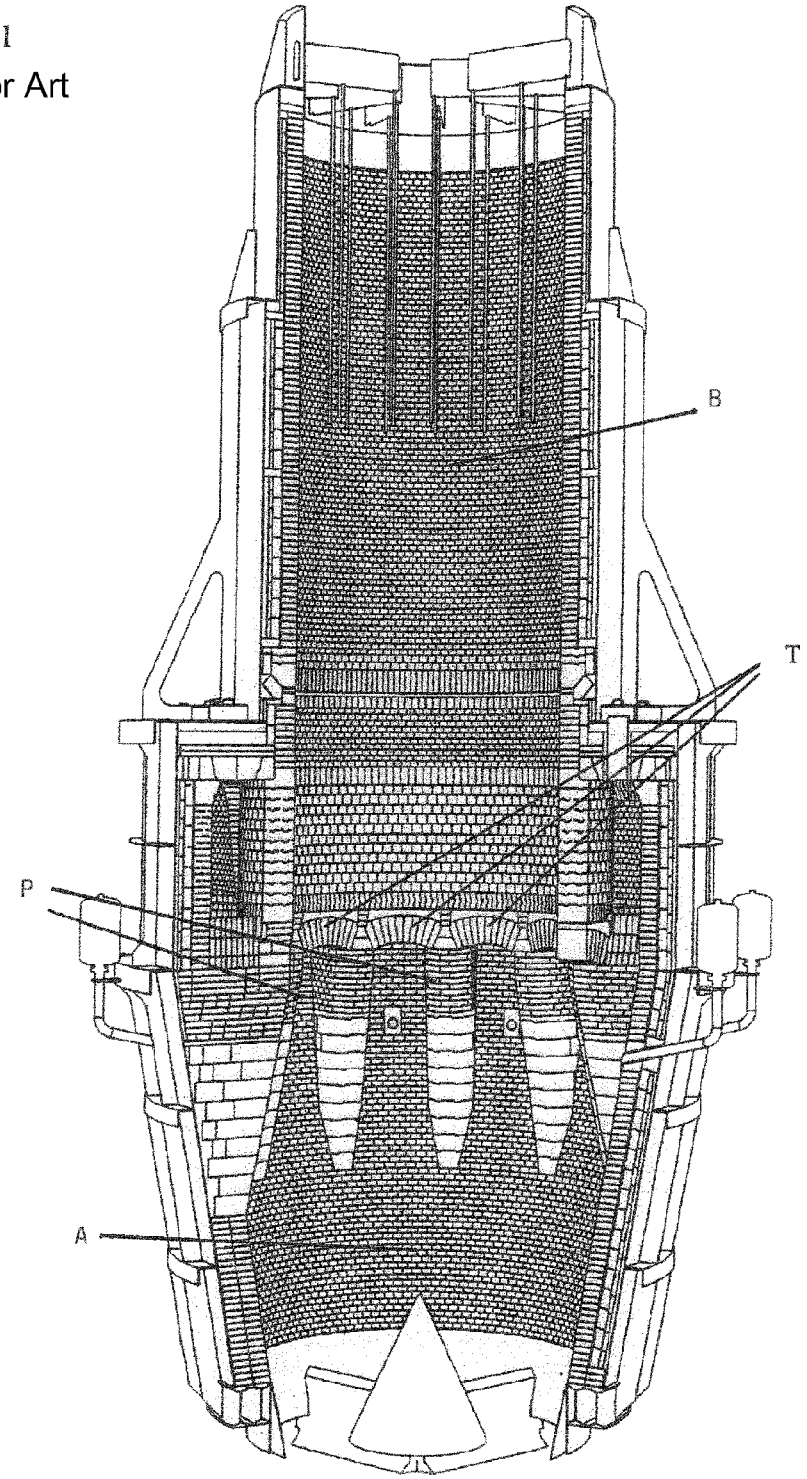
FIG. 1 Prior Art

Particularly the last-mentioned embodiment has proved to be successful and is for example used in lime shaft kilns of the GGR type (co-current flow, counterflow, regenerative). FIG. 1 shows a schematic display of this furnace, partially cut away, with a number of such support arches T, wherein each support arch rests on corresponding pillars P at its ends.

Thermal strain (expansion) in the bricks of the support construction inevitably takes place during the preheating and cooling down of the furnace. In arch constructions of the named type, the problem is that such strain, especially in a horizontal direction, can hardly or not at all be compensated for. In a worst case scenario, individual bricks are pushed radially to the outside (upwards), the brick network is weakened and individual bricks can even break or fall out, so that the arch construction collapses.

Even if the last-mentioned case is only an exception, there is the desire to optimize the support construction in such a way that strain/expansions in the brick material, especially strain in the horizontal direction, can be compensated for better.

In order to solve this problem, the invention leaves the known arch constructions and suggests, in its most general embodiment, a bridgelike support construction made out of fireproof (refractory) ceramic bricks, which features the following arrangement in its mounted state, looked at from both its free outer ends towards the inside:

- Two outer bearing bricks at the ends, each of which
- features at least one generally horizontal step on their inside,
- a keystone (key brick, closing brick) which is arranged between the two bearing bricks, which
- features at least one generally horizontal step on both outer sides (which means in direction of the bearing bricks), wherein
- at least one of the horizontal steps of each outer side of the keystone rests on a corresponding horizontal step of the inside of the corresponding bearing brick and
- the bearing bricks and the keystone are incidentally designed an dimensioned such that they
- form an integral bridge like support construction together and
- the support construction is self-supporting, if only the outer bearing bricks are at least partially resting on corresponding bearings.

The description of the geometry of the bricks and the support construction is generally done in such a way that the mounted state is looked at, as displayed in FIG. 1 as the state of art, "Outside" respectively means in direction of the supports (pillars, bearings), "inside" means towards the centre of the support construction (in a longitudinal direction between two supports), "front side" is understood to be towards the furnace space, "back side" respectively oppositely, thus towards the furnace envelope, "up" and "upper side" is understood to be "upwards" in the vertical direction and in application on FIG. 1 in direction of the overlaying firing zone B, und "down" or "bottom" ("bottom side) analogously in direction of the outlet zone A of the furnace. When the support structure is used in different aggregates the orientations mentioned above are valid analogously.

A first fundamental feature of the support construction according to the invention lies in the fact that each brick features at least one generally horizontal step. "Generally horizontal" means that the step is ideally horizontal in the mounted position, but can also run slightly slanted/inclined towards the horizontal, wherein the corresponding angle of inclination/declination should be <10°, <5°, <2° in any case. The steps particularly run continuously from one front side of each brick of the named embodiment of the support construction to a back side (rear surface).

Due to the fact that the keystone, which lies on the inside (centrally) of the support construction, rests on the steps of the bearing bricks which lie on the outside, a self-supporting support construction is created using bricks with a simple geometric shape.

The support construction is suited for widths (between bearings at its ends) of up to 3,000 mm, while a support construction, at which at least one intermediate brick is placed between the keystone and each bearing brick, wherein the intermediate bricks again feature at least one generally horizontal step on their inside and outside, shows advantages for widths above 500 mm and especially above 1.000 mm.

A support construction with two of these intermediate bricks is constructed as follows:

- an intermediate brick is placed between the keystone and each bearing brick, which
- features at least one generally horizontal step on its inside and on its outside, wherein
- at least one of the horizontal steps of each outside of the keystone rests on a corresponding horizontal step of an inside of the corresponding intermediate brick, and
- at least one horizontal step of each outside of the intermediate brick rests on a corresponding horizontal step of an inside of the corresponding bearing brick, and
- the bearing bricks, the intermediate bricks and the keystone are incidentally designed and dimensioned in such a way that together, they
- form an integral bridgelike support construction and
- the support construction is self-supporting, if only the outer bearing bricks are resting at least partially on corresponding supports.

In the case of more than two intermediate bricks the support construction can be described to that effect that:

- at least one further intermediate brick is placed between the intermediate brick and each bearing brick, which
- features at least one generally horizontal step on its inside and on its outside, wherein
- at least one of the horizontal steps of each outside of the intermediate brick rests on a corresponding horizontal step of an inside of the corresponding further intermediate brick, and
- at least one horizontal step of each outside of each further intermediate brick rests on a corresponding horizontal step of an inside of the corresponding further intermediate brick, which lies further outside, or respectively of the bearing brick, and the bearing bricks, the intermediate bricks, the further intermediate bricks and the keystone are incidentally designed and dimensioned in such a way that together, they form an integral bridgelike support construction and the support construction is self-supporting, if only the outer bearing bricks are resting at least partially on corresponding supports.

In these embodiments with at least two intermediate bricks the general principle of the support construction mentioned above also remains, because in this case the bricks which lie further on the inside of the support construction also rest on corresponding steps of the outer adjacent bricks in the area of the named steps, so that if a force is exerted on the support construction from above, it is passed downwards, or respectively into the bearing bricks.

The horizontal contact areas of the bricks create the possibility to compensate for the strain in the bricks in a horizontal direction by inducing a horizontal parallel shift of adjacent bricks along the horizontal steps. In this context it is important that the generally vertical or slanted area segments of the insides and outsides of adjacent bricks are at a certain distance to each other, thus having grooves (joints) between them, in order to compensate for the horizontal shift between individual bricks.

For that matter, a sealing material, for example a ceramic fibre gasket, an elastic glue or deformable mortar, can be arranged between the inner and outer surfaces of adjacent bricks as well as in the area of the steps between adjacent bricks.

The new construction has the advantage over the mentioned state of the art that a radial expansion of a support ring formed of multiple support constructions is avoided.

The arrangement of the bricks within the support construction can take place in such a way that all bricks form a common, generally horizontal upper side. This is important because brickwork is often laid on top of the support construction. This is particularly easy in case of a horizontal upper side of the support construction and possible without filling material or special formats/shapes of bricks.

Analogously the bricks within the support construction can also form a common, generally horizontal bottom side.

Here it is also valid that the term "generally horizontal" is not to be understood in a strictly geometrical way, but also allows for equivalent variations or embodiments. Insofar, the respective surface segments of the bricks can also be corrugated or feature another profile, or respectively be designed in a slightly curved way.

The geometry of the individual bricks can be chosen in such a way that at least one step of each brick lies on the same level as at least one step of another brick. It is also possible for all steps within a support construction to align with each other, thus to lie on a common level.

In case of multiple steps along the inner or outer side of a brick, they are for example arranged in a step like manner. If the steps lying/arranged further to the outside within the brick compound of the support construction run vertically offset downwardly, an optimized force deflection can be achieved in this embodiment and in case of a support construction with intermediate bricks. This results in an image, where the steps lying on the inside run at a higher level than the steps lying on the outside, in the side view of the support construction. This embodiment is also displayed and further described in the following figure description.

Within the support construction, the keystone can feature an approximated T-shape in its front view and its lower segment can conically narrow towards the bottom side of the support arch, even though an embodiment with a constant cross section is also possible.

The keystone features an anomaly compared to the intermediate brick insofar as that it only features two outer sides with at least one step each.

The keystone can also be vertically split in an embodiment according to the invention analogously to the subject of the DE 39 33 744; however this split would not have any technical use in terms of the invention and would only increase the number of components and prolong the mounting.

Both bearing bricks at the ends have the anomaly compared to the intermediate bricks, that only their inner side is in contact with a further brick of the respective support constructions, while the outside of each bearing brick is either exposed or rests against a support. Insofar another embodiment of the invention suggests designing the bearing bricks in the front view with an L-shape, or respectively a mirrored L-shape. In doing so the outer side of each bearing brick can generally run vertically and the inner side can be at an angle of >0 to the vertical outside of the step(s).

As shown in the principal presentation in FIG. 1, multiple support constructions (there: support arches) follow each other at the arrangement of the displayed lime shaft kiln, which overall form a kind of a support ring.

For this application, a single support construction can be designed in such a way that at least one brick features a geometry where the inside and the outside of the brick do not run parallel to each other, so that the brick features for example a trapezoidal shape in the top view. The slimmer face can be at the front or at the back.

The support construction can also be designed in such a way that at least one brick features a geometry wherein the inside and the outside of the brick are generally parallel, so that the brick features at least approximately a rectangular shape in the top view.

Any combination of bricks with different shapes (each in the top view) is possible within the support construction, for example: Bricks with a trapezoidal shape, which narrow towards the front; Bricks with a trapezoidal shape, which narrow towards the back; Bricks with a rectangular shape. In doing so, a loosening of bricks towards the front or the back can be avoided. The arrangement always takes place in such a way that the integral, self-supporting structure of the support construction is maintained.

It is advantageous if the grooves (in the top view) between adjacent bricks feature a generally constant width, but slightly wedged groove geometries are also possible.

Finally, the support construction can also be constructed in such a way that the bricks feature at least one curved face, so that the bricks are designed and arranged in such a way that at least one face of the support construction is curved. In an extreme case, a support ring of multiple support constructions is formed, wherein the inner cylindrical area of the ring is parallel to the cylindrical outer area of the ring. Geometries with planar brick faces at the front and/or back are also possible, which result in a polygonal progression of the front and/or back side of the whole support construction.

In the following, further possible embodiments of the support construction, or rather of the bricks forming the support construction, as well as advantages over the state or the art are described, which may be realised on their own or in combinations.

The bricks are not supported along their generally vertical inner- or outer surfaces by the adjacent bricks, but mainly to completely by the named horizontal steps.

Thereby the possibility of a horizontal shift/expansion of each element is given.

The support construction is preferably designed in a mirror symmetrical manner in relation to a level centrally between the end bricks (bearing bricks). This results in for example 3, 5, 7, 9 or 11 bricks for a support construction in case of a one-piece keystone.

The vertical load of brickwork above the support construction is mainly to completely spread onto the end bricks and from there onto the supports through the horizontal support surfaces between the bricks. The strength of the bricks determines the maximum pressure load, which results from the number and size of the individual horizontal support surfaces (steps) with a given load, which is allowed.

The width of the steps depends on the size of the bricks, the distance between the supports and the size of the forces to be supported in order to keep the support construction self-supporting and stable. It can be for example 15 to 200 mm, especially 20 to 100 mm, with lower limits also at 30, 40, 50 mm.

Further typical dimensions for individual bricks within the support construction are: height: 200 to 1000 mm, width: 200 to 1400 mm, length: 200 to 700 mm, where the length describes the length between the front and back face in the mounted state.

The outer and inner surfaces of the bricks can be exactly vertical or at an angle to the vertical, wherein the angle should be <45° in any case, with lower limits of 3°, 5°, 8°, 10° and upper limits for example at 15°, 20°, 25° or 30°.

As already mentioned, the bricks can also be designed with multiple horizontal steps. Obviously corresponding adjacent bricks then also have to be designed with a corresponding number of steps on their outer and inner surfaces so that a form-fit connection within the support construction is created again.

The vertical or slanted outer/inner surfaces only have to absorb the bending moments of the spread load. The size of the bending moments is given by the size of the load resting on the support construction and the geometry of the bricks.

The groove size between the inner/outer surfaces of adjacent bricks is not of primary importance. A minimum size of 5 mm, 10 mm or 15 mm is advantageous. As described above, these grooves can also feature different widths.

The grooves can be filled with minerals which have a lower strength than the material of the individual bricks. Materials that deform continuously, thus proportionally to the exerted force, under pressure, for example caused by the mentioned strain in the bricks, and/or feature an elastic deformation behaviour are advantageous. Suited are for example high temperature resisting fibre materials in the form of mats, plates, felts or interlaced yarns, but also glues or mortars with such deformation properties also at higher temperatures.

The bricks can be made of different fireproof materials. For example materials based on sintered Magnesia (MgO) are suited. In that case the MgO-part can be above 83 M-% and the rest can for example consist of $Al_2O_3$, $Fe_2O_3$, $SiO_2$, CaO and/or $P_2O_5$. Bricks, for example casted bricks, made of this can feature a density of 2.8 g/cm$^3$ (EN 993-1), a cold compression strength of 30 N/mm$^2$ or more (EN 993-5), a hot bending strength of 3.0 N/mm$^2$ or more at 1,400° C. (EN 993-7) and/or an open porosity of for example 8 to 20 Vol.-% (EN 993-1).

Further characteristics of the invention arise from the characteristics of the sub claims as well as the other application documents. The invention is further described in the following with the help of an embodiment. It is shown, each in a strongly schematic display:

FIG. 1: a view of a support construction.

Figure 2:
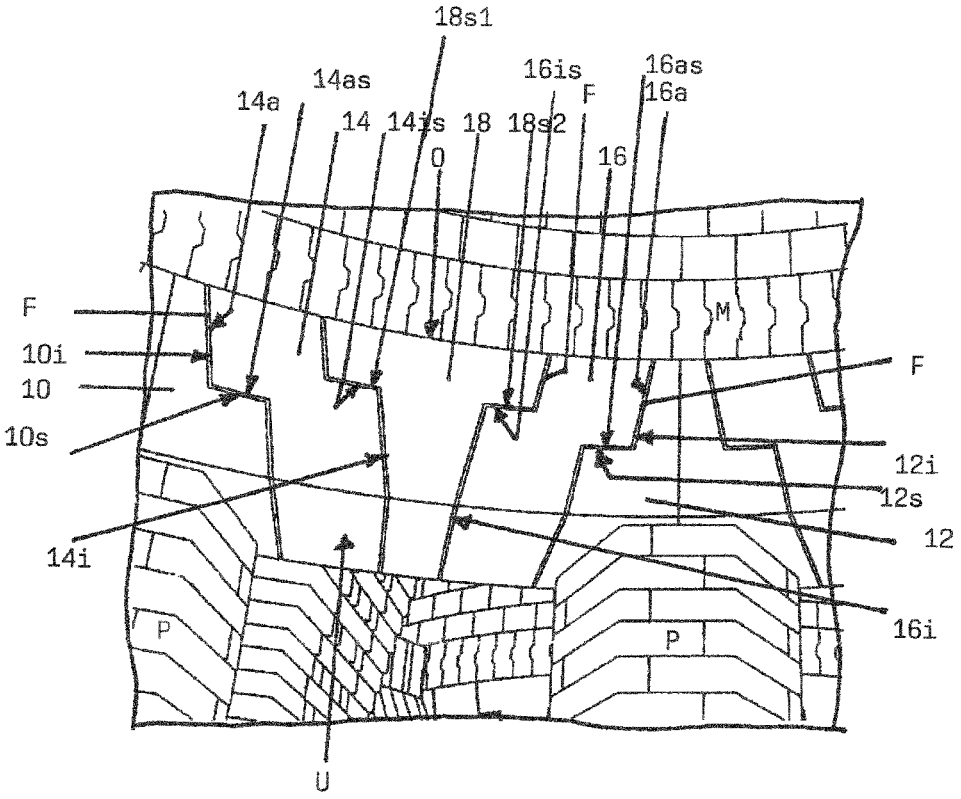

FIG. 2: a view of the support construction from below and from the front.

Figure 3:
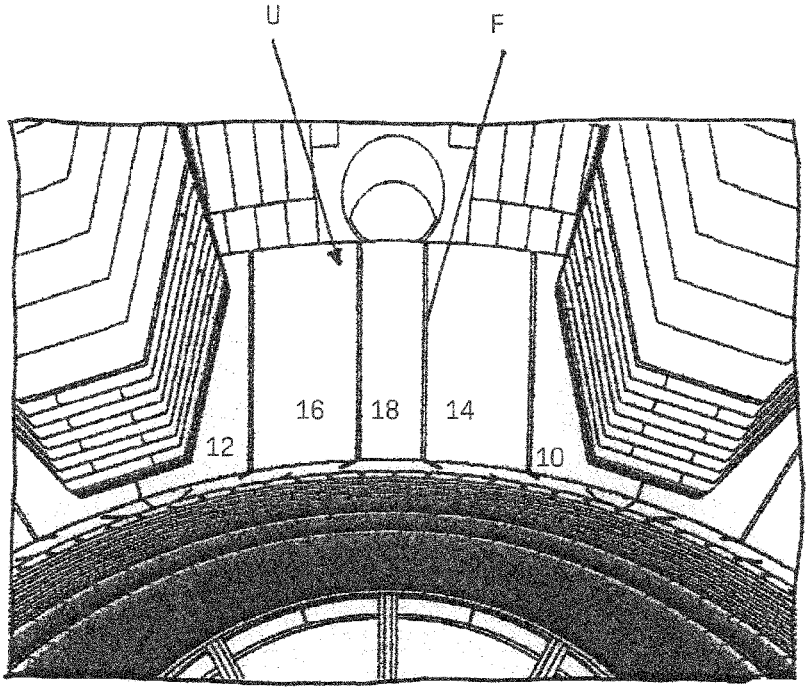

FIG. 3: a view of the bottom side of the support construction according to FIG. 2

Figure 4:
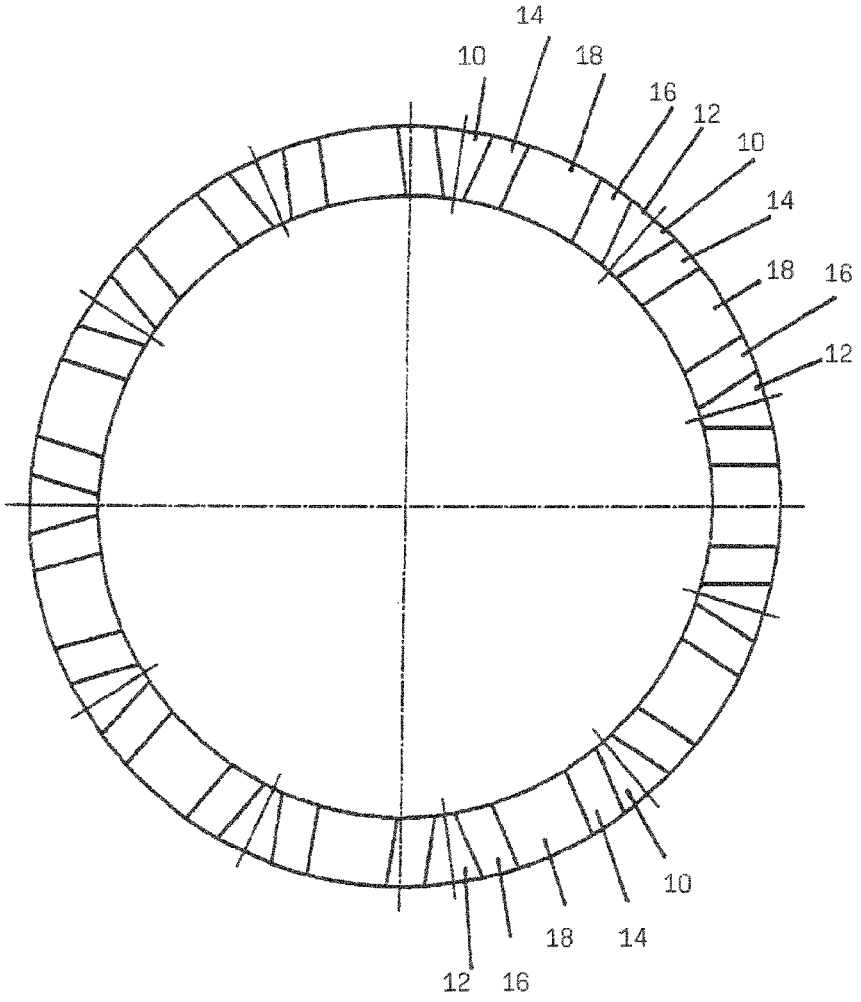

FIG. 4: A view of a support ring formed of multiple support constructions

Figure 5:
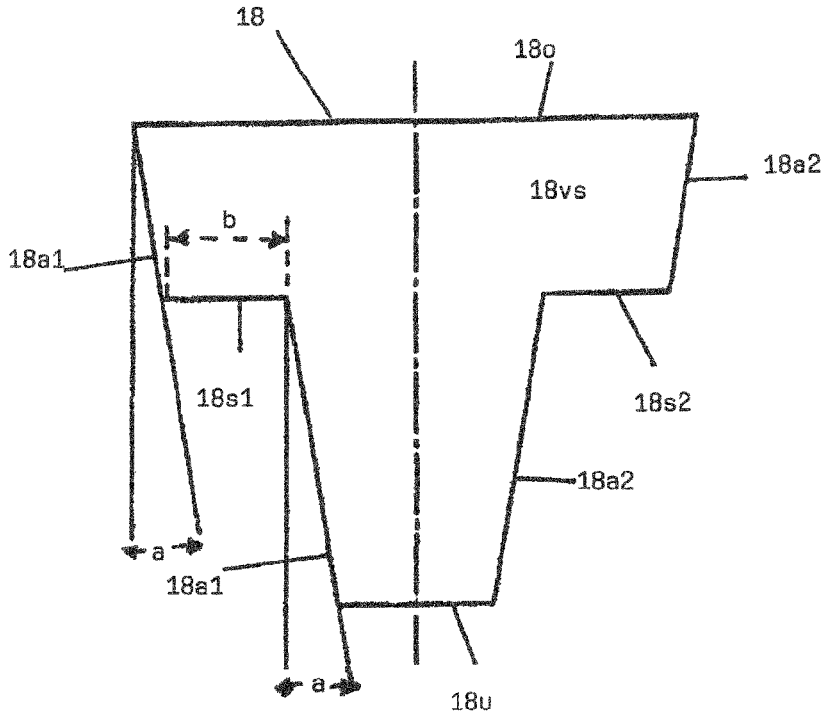
Figure 5:
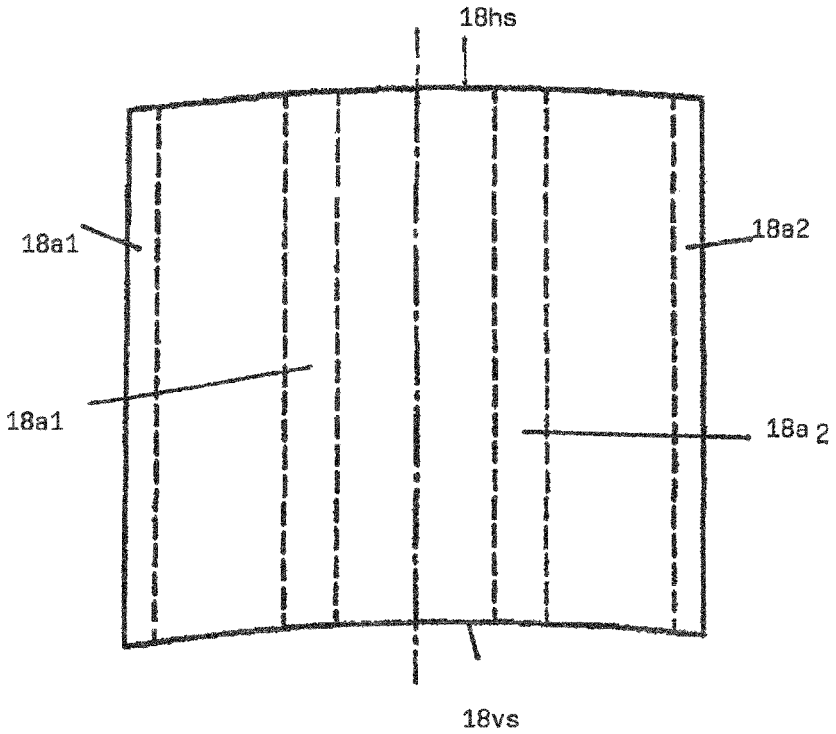

FIG. 5: a side view and a top view of a keystone

Figure 6:
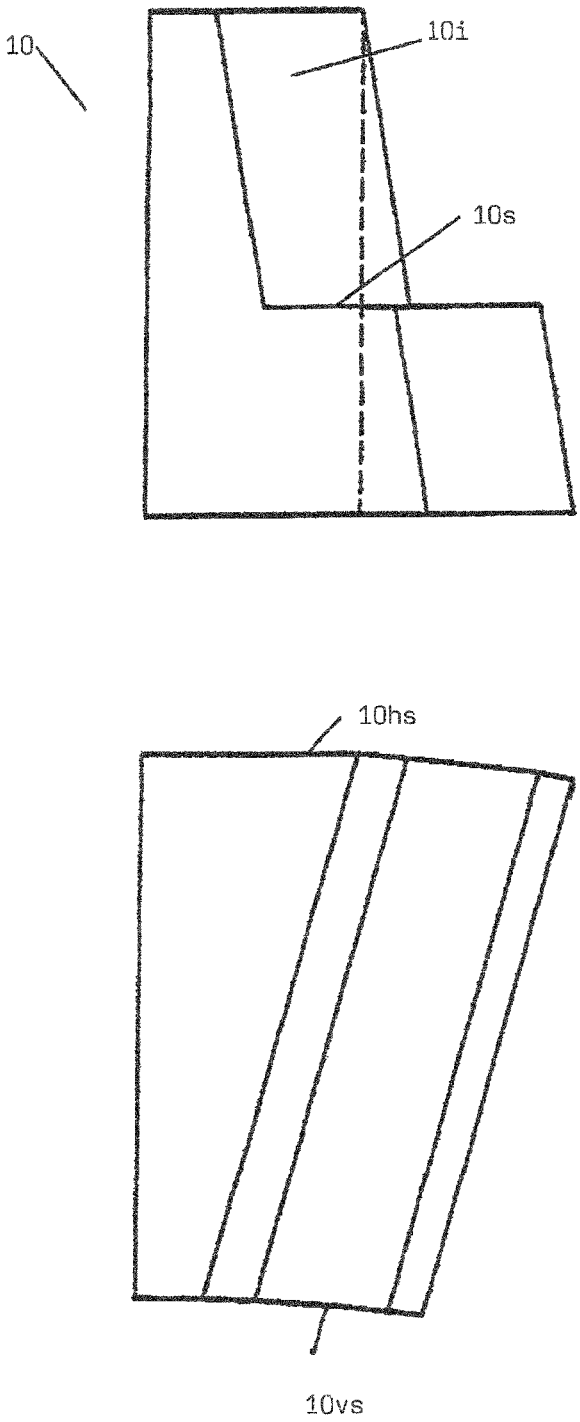

FIG. 6: a side view and a top view of a bearing brick

Figure 7:
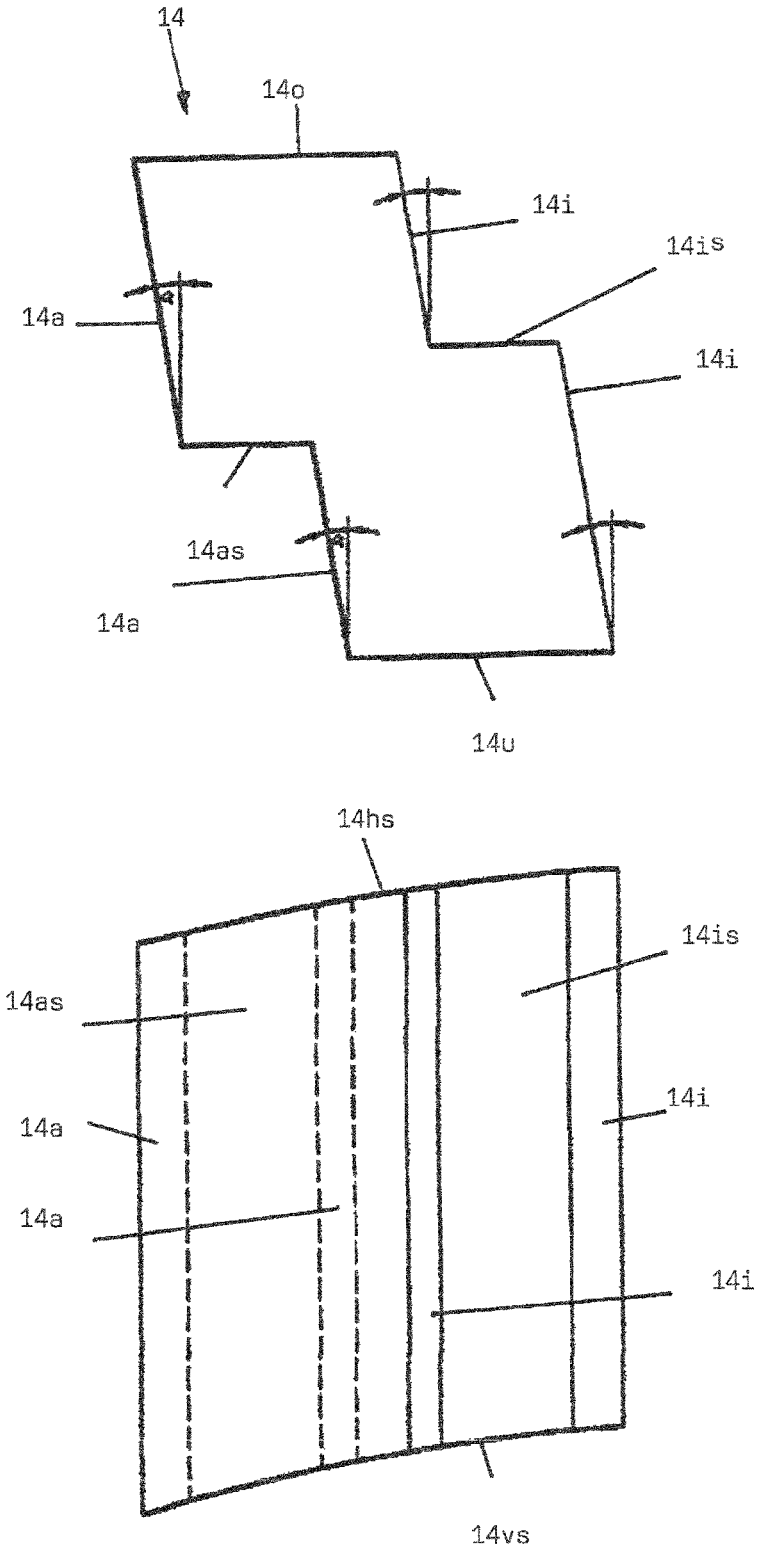

FIG. 7: a side view and a top view of an intermediate brick

The support construction according to FIG. 2 consists of two outer bearing bricks (end bricks) 10, 12, two subsequent intermediate bricks 14, 16 on their inside and a central keystone 18. In the face view (from the front and the back) the end bricks feature an L-shape (or respectively a mirrored L-shape), the intermediate bricks feature an abstracted S-shape and the keystone a T-shape.

Grooves F, which are filled with a ceramic, high temperature resistant fibre material, can be seen between adjacent bricks.

The outer bearing bricks feature a horizontal step 10*s*, 12*s* on their inside, while the segments of the insides 10*i*, 12*i* of the bearing bricks 10, 12 following upwards and downwards run at an angle of approximately 10° to the vertical, in such a way that the bearing bricks 10, 12 are getting wider from the top to the bottom.

The intermediate bricks 14, 16 rests on the steps 10*s*, 12*s* with their corresponding steps 14*as*, 16*as*, or to be more accurate: the intermediate bricks 14, 16 rest on a fibre mat, which rests on the steps 10*s*, 12*s*.

The intermediate bricks 14, 16 also feature a step 14*is*, 14*is* on their inside. The steps 14*is*, 16*is* serve the support of corresponding steps 18*s*1, 18*s*2 in the area of the outer surfaces 18*a*1, 18*a*2 of the keystone 18.

Outside the steps the outer sides 14*a*, 16*a* as well as the inner sides 14*i*, 16*i* of the intermediate bricks 14, 16, further the outer sides 18*a*1, 18*a*2 of the keystone 18 are generally parallel to the inner surfaces 10*i*, 12*i* of the bearing bricks 10, 12

The described arrangement of the bricks 10, 12, 14, 16, 18 overall results in an integral (continuous, compact) bridgelike support construction, wherein the support construction is self-supporting, even though only the outer bearing bricks 10, 12 only partially rest on the corresponding supports (pillars P).

The upper side O and the bottom side U of the support construction are generally planar and horizontal in the displayed embodiment. This is analogously valid for the respective segments of the upper side O, or respectively the bottom side U of each individual brick 10, 12, 14, 16, 18.

Brickwork M is built on top of the upper side O.

Because the keystone 18 rests on the steps 14*is*, 16*is* of the intermediate bricks 14, 16 with its steps 18*s*1, 18*s*2 and the intermediate bricks 14, 16 rest on the steps 10*s*, 12*s* of the bearing bricks 10, 12 with their outer steps 14*as*, 16*as*, the vertical load of the brickwork M is spread through these horizontal support surfaces onto the outer (at the ends) supports (pillars P).

As shown in FIG. 2, the inner steps 14*is*, 16*is* of the intermediate bricks 14, 16 run at a different height (namely above) to the outer steps 14*as*, 16*as*, whereby the spreading of the load is advantaged.

FIG. 3 shows that all bricks 10, 12, 14, 16, 18 feature a generally rectangular base area in a view from below (as well as in a view from above).

In FIG. 4, a support ring constructed of multiple, namely 11 support constructions according to FIG. 2, can be seen. The supports (pillars) (not displayed) run below the bearing bricks 10, 12.

FIGS. 5 to 7 show details of the different bricks of a support construction. For that matter only characteristics which have not already been described in relation to the previous figures are named.

The keystone according to FIG. 5 features steps 18*s*1, 18*s*2 with a width (b) of approximately 100 mm each. The already mentioned angle of slant (a) of the outer surfaces 18*a*1, 18*a*2 is approximately 10°. While the front face 18*vs* and the back face 18*hs* are each slightly curved, the upper side 18*o* and the bottom side 18*u* are generally plane/planar and horizontal within the support construction.

A bearing brick is displayed in FIG. 6 and designed as follows:

The front face (10*vs*) and back face 10*hs* of the bearing brick 19 are curved similarly to the keystone 18 according to FIG. 5. However, the bearing brick 10 is wider at the back than at the front, according to the radius of curvature of the whole support arch. The inside 10*i* runs slanted/inclined at an angle of approximately 10° to the vertical (similarly to the outer surface 18*a*1 at the keystone 18) above and below a horizontally orientated step 10*s*.

The step 10*s* could also be designed in a slightly profiled way, for example slightly curved. A corresponding curvature would cause the step between the front face and back face of the brick to feature a hill or mountain shape, while the geometry of adjacent bricks is respectively adjusted. In other words: The step would then feature for example a certain radius, but would also still be generally horizontal in direction of the adjacent brick in order to not influence the desired horizontal shift. Instead of a curvature, appropriate corresponding male/female/geometries can also be designed in the area of the steps of adjacent bricks, again without affecting the possibility of general horizontal shifts between adjacent bricks.

The intermediate brick according to FIG. 7 is also characterized by planar upper and bottom side 14*o*, 14*u* and curved front and back sides (faces) 14*vs*, 14*hs*. The width of each step 14*as* is approximately 100 mm. The steps 14*as*, 14*is* are vertically shifted to each other in this case, as in the embodiment according to FIG. 2.

Regarding their slope, the inner and outer surfaces 14*a*, 14*i* correspond to the outer surfaces 18*a*1, 18*a*2 of the keystone (key piece) 18 according to FIG. 5.

The invention comprises support constructions, which are designed mirror inverted to a mirror plane, which is perpendicular to the longitudinal extension of the support construction (between the end bricks).

The invention also comprises "asymmetrical" embodiments. Such an asymmetry can for example occur when:

- Both end bricks feature a different size, particularly a different width,
- Intermediate bricks on both sides of a keystone feature a different geometry, particularly a different width,
- The support construction features a different number of intermediate bricks on opposite sides of the keystone,
- The keystone (independent of it being one-piece or multipart) is asymmetrical to the mirror plane which runs centrally between both outer surfaces and is generally parallel to these.

Such asymmetrical arrangements of bricks can be achieved by any brick-combination and can, amongst other things, be useful for repairs.

Nothing is changed about the general design of the support arch by this.

Especially the meaning and functioning of the horizontal steps remain unchanged. The previous explanation is analogously referenced to.

The invention claimed is:

1. Bridgelike support construction made out of fireproof ceramic bricks (10, 12, 18), which features the following arrangement in its mounted state, looked at from both its free outer ends toward the inside:

a) two outer bearing bricks (10, 12) at the ends, each of which b) features at least one generally horizontal step (10*s*, 12*s*) on their inside, c) a keystone (18) which is arranged between the two bearing bricks (10, 12), which d) features at least one generally horizontal step (18*s*1, 18*s*2) on both outer sides (18*a*1, 18*a*2), wherein e) at least an intermediate brick (14, 16) is placed between the keystone (18) and each bearing brick (10, 12), which f) features at least one generally horizontal step (14*is*, 14*as*, 16*is*, 16*as*) on its inside (14*i*, 16*i*) and on its outside (14*a*, 16*a*), wherein g) at least one of the horizontal steps (18*s*1, 18*s*2) of each outside (18*a*1, 18*a*2) of the keystone (18) rests on a corresponding horizontal step (14*is*, 16*is*) of an inside (14*i*, 16*i*) of the corresponding intermediate brick (14, 16), and h) at least one horizontal step (14*as*, 16*as*) of each outside (14*a*, 16*a*) of the intermediate brick (14, 16) rests on a corresponding horizontal step (10*s*, 12*s*) of an inside (10*i*, 12*i*) of the corresponding bearing brick (10, 12), wherein i) the step arranged on the inside of an intermediate brick runs at a higher level than the step arranged on the outside of said intermediate brick seen in a side view of the support construction and j) the bearing bricks (10, 12), the intermediate bricks (14, 16) and the keystone (18) are incidentally designed and dimensioned in such a way that together, they form an integral bridgelike support construction, wherein all bricks (10, 12, 14, 16, 18) create a common, generally horizontal upper side (O), and k) only the outer bearing bricks (10, 12) are resting at least partially on corresponding supports (P).

2. Support construction according to claim 1, wherein a) at least one further intermediate brick is placed between each intermediate brick (14, 16) and each bearing brick (10, 12), which b) features at least one generally horizontal step on its inside and on its outside, wherein c) at least one of the horizontal steps (14*as*, 16*as*) of each outside (14*a*, 16*a*) of each intermediate brick (14, 16) rests on a corresponding horizontal step of an inside of the corresponding intermediate brick, and d) at least one horizontal step of each outside of each further intermediate brick rests on a corresponding horizontal step of an inside of the corresponding further intermediate brick, which lies further outside, or respectively of the bearing brick (10, 12), and e) the bearing bricks (10, 12), the intermediate bricks (14, 16), the further intermediate bricks and the keystone (18) are incidentally designed and dimensioned in such a way that together, they f) form an integral bridgelike support construction.

3. Support construction according to claim 1 or 2, wherein all the bricks (10, 12, 14, 16, 18) create a common, generally horizontal bottom side (U).

4. Support construction according to claim 1 or 2, wherein at least one step of each brick aligns with at least one step of an adjacent brick.

5. Support construction according to claim 1 or 2, wherein at least one step of each brick that is further outside aligns with at least one step of another brick, which is adjacent on the inside.

6. Support construction according to claim 1 or 2, wherein the corresponding inner and outer surfaces of adjacent bricks (10, 14; 14, 18; 18, 16; 16, 12) are at an angle of 0 degrees to the vertical (V) outside of their steps.

7. Support construction according to claim 1, wherein the keystone (18) features an approximated T-shape in its front view and a lower segment conically narrows toward a bottom side of the support construction.

8. Support construction according to claim 1, wherein the bearing bricks (10, 12) feature an approximated L-shape, or respectively a mirrored L-shape, in the front view.

9. Support construction according to claim 1, wherein the bearing bricks (10, 12) feature a generally vertical outer surface.

10. Support construction according to claim 1 or 2, wherein at least one brick (10, 12, 14, 16, 18) features a geometry, at which the inside and the outside of the brick (10, 12, 14, 16, 18) are diverging toward each other, so that the brick (10, 12, 14, 16, 18) features an approximated trapezoidal shape in the top view.

11. Support construction according to claim 1 or 2, wherein at least one brick (10, 12, 14, 16, 18) features a geometry, at which the inside and the outside of the brick (10, 12, 14, 16, 18) are generally parallel, so that the brick (10, 12, 14, 16, 18) features an approximated rectangular shape in the top view.

12. Support construction according to claim 1 or 2, wherein the bricks (10, 12, 14, 16, 18) are designed and arranged in such a way that at least one face of the support construction is curved.

13. Support construction according to claim 1 or 2, wherein each brick includes at least one area segment and wherein a gasket, glue or mortar is at least partially arranged between adjacent area segments of adjacent bricks.

* * * * *